US006822208B2

(12) United States Patent
Henze et al.

(10) Patent No.: US 6,822,208 B2
(45) Date of Patent: Nov. 23, 2004

(54) MICROWAVE DOOR WITH VIEWING WINDOW

(75) Inventors: Inka Henze, Udenheim (DE); Stefan Bauer, Alzey (DE); Oliver Gros, Rheinboellen (DE); Bernd Schultheis, Schwabenheim (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/782,156

(22) Filed: Feb. 19, 2004

(65) Prior Publication Data

US 2004/0164075 A1 Aug. 26, 2004

(30) Foreign Application Priority Data

Feb. 20, 2003 (DE) ..... 103 07 217

(51) Int. Cl.[7] ..... H05B 6/76

(52) U.S. Cl. ..... 219/740; 219/744; 219/739; 219/741; 126/198; 126/200; 174/35 MS

(58) Field of Search ..... 219/740, 744, 219/739, 736, 729, 738, 522, 203, 218, 219, 543; 126/200, 198; 338/308, 359; 427/165; 52/171.3; 62/248; 174/35 R, 35 MS, 35 GC

(56) References Cited

U.S. PATENT DOCUMENTS

| | | | | |
|---|---|---|---|---|
| 3,679,855 A | * | 7/1972 | Binzer | 219/740 |
| 4,382,177 A | * | 5/1983 | Heaney | 219/522 |
| 4,929,574 A | | 5/1990 | Iltis et al. | |
| 6,024,084 A | * | 2/2000 | Gerhardinger | 126/200 |
| 2003/0029440 A1 | | 2/2003 | Gross et al. | |
| 2003/0113550 A1 | | 6/2003 | Millette et al. | |

FOREIGN PATENT DOCUMENTS

| | | |
|---|---|---|
| DE | 30 32 998 A1 | 4/1982 |
| DE | 32 31 516 A1 | 3/1984 |
| DE | 36 44 276 A1 | 7/1988 |
| DE | 39 23 734 C1 | 8/1990 |
| DE | 42 33 471 A1 | 4/1994 |
| DE | 44 23 100 C1 | 7/1995 |
| DE | 200 22 402 U1 | 9/2001 |
| EP | 0 406 728 | 1/1991 |
| EP | 0 529 222 A2 | 3/1993 |

* cited by examiner

*Primary Examiner*—Shawntina Fuqua
(74) *Attorney, Agent, or Firm*—Michael J. Striker

(57) ABSTRACT

The microwave unit door includes a metallic door frame (1) with an interior glass pane (3) and outer glass pane (2) held spaced apart in it. To improve the observability of the interior of the microwave unit without loosing the microwave shielding effect, e.g. previously provided by a metal screen between the glass panes, and to prevent condensate formation, the interior glass pane (3) closest to the processing space (I) has at least one optically transparent electrically conductive first layer (13) with a microwave absorption capability such that it heats up to prevent condensate formation during operation. The outer glass pane (2) has at least one optically transparent electrically conductive second layer (12) reflecting microwaves passing through the first layer.

16 Claims, 5 Drawing Sheets

MICROWAVE DOOR WITH VIEWING WINDOW

BACKGROUND OF THE INVENTION

1. Field of the Invention

The present invention relates to a microwave unit door with a viewing window, which closes a processing, cooking or heating space, and comprises a metallic door frame, in which at least two glass panes are held spaced apart from each other, and in which the viewing window has an optically transparent conductive coating or layer for shielding or screening off the propagated microwave radiation and for preventing formation of a water vapor condensate.

2. Description of the Related Art

Doors for microwave units typically have a viewing window, in order to be able to better observe the heating or cooking process performed in the microwave unit. This viewing window comprises, in a known manner, two glass panes arranged spaced apart from each other in a metallic frame, which are made from high-temperature-resistant glass. Since this glass is also transparent for microwaves to a considerable extent, a screen or shield against microwave radiation is required within the metallic frame in the vicinity of the viewing window.

In known microwave units this screen or shield comprises a black metallic perforated plate, which is rigidly attached in the space between both glass panes and is in conductive contact with the metallic frame. This comparatively heavy perforated metallic plate, also is called a screen or grate, which of course shields from the microwave radiation to the required extent, but which impairs the observation of the interior of the microwave unit to a significant extent. This is similar in microwave units in which the metallic screen is printed on one of the glass panes (DE 32 31 516 A1). At the same time with current units of this type water droplets form during heating up, which deposit on the interior glass pane and because of that also obstruct the observation through the window.

Microwave viewing windows are already known in the state of the art, which permit improved observation of the interior and prevent condensation on the window. DE 30 32 998 C2 describes a viewing window for a microwave unit, which can comprise one or more glass plates, and which is provided with a thin transparent metal layer on the inner surface facing the processing chamber, whose thickness is selected so that, on the one hand, the transparent glass material is heated by the high frequency currents flowing in this metal layer during operation of the microwave unit, so that condensation of water vapor on the interior surfaces of the viewing window occurring during food processing is prevented. On the other hand, the thickness is selected so that passage of the microwave radiation generated by the microwave generator and conducted through the wave guide into the processing or heating space does not pass through the viewing window, i.e. it is reflected back into the processing space.

The heat up of the layer for preventing condensation on the viewing window, on the one hand, and the reflection of microwave radiation back into the processing space, on the other hand, require different design features of the metal layer due to the different physical effects. Because of that compromises must be made in the known case so that both functions are not optimal.

Thus in later work the microwave door with viewing window is equipped with only one or the other function. DE 36 44 276 A1, DE 39 23 734 C1 and DE 44 23 100 C1 disclose metallic layers applied to the inner glass pane exclusively or only for shielding from the microwave radiation. DE 39 23 734 C1 describes a practical transparent conductive coating, which comprises an indium oxide-zinc oxide mixture or zinc oxide with a preferred thickness between 0.5 $\mu$m and 1 $\mu$m, with a maximum surface resistance of 10 Ohm.

DE 42 33 471 A1 describes a metallic coating applied to the inner pane of the viewing window exclusively for preventing condensate formation.

SUMMARY OF THE INVENTION

It is an object of the present invention to form a microwave unit door with a viewing window of the above-described kind, so that the viewing window facilitates improved observation of the interior of the microwave unit with the required optimized shielding from microwave radiation and prevents condensation from the interior in a very effective manner.

This object and others, which will be made more apparent hereinafter, are successfully attained in a microwave unit door with a viewing window, which closes a processing or interior space of the microwave unit, which comprises a metallic door frame and two glass panes held spaced apart in the door frame, in which the viewing window has an optically transparent conductive layer for screening or shielding from microwave radiation and for preventing condensation of water vapor.

According to the invention the interior glass pane closest to or facing the processing space has at least one optically transparent first layer absorbing microwave radiation, which is designed regarding microwave absorption ability, so that it heats up to prevent condensate formation. The outer glass pane has at least one optically transparent second layer that reflects microwave radiation passing through the first layer.

The first layer directed to or facing the processing space heats up because of absorption of part of the microwave radiation and thus prevents water vapor condensation. Furthermore it shields or screens off the microwave radiation to a certain extent. The second layer faces the surroundings or exterior of the unit and reflects the remaining radiation, which passes through the first layer, completely toward the interior, i.e. provides the necessary screening for maintaining the prescribed limits. Since the door according to the invention with the viewing window has its own layer for each function—respectively radiation shielding and condensate prevention, each layer can be optimized independently of the others to fulfill its function.

Furthermore there is a redundancy regarding screening, if one glass pane breaks.

According to a first embodiment of the invention the microwave door is formed so that the first layer is built up on the side of the interior glass pane, which is immediately adjacent to the processing space, i.e. the inner side. In this embodiment it is appropriate that the first layer is additionally provided with an outer scratch protecting coating, preferably a silicone oxide coating, which prevents mechanically rubbing off or abrasion of the first layer during use of the unit.

Alternatively in another embodiment the microwave unit door is formed so that the first layer is on the outer side of the interior glass pane, which faces away from the processing space. In this embodiment the interior glass pane is preferably formed as a thin carrier pane, i.e. thinner than the outer glass pane, since it must be heated up in the heat up phase and thus should have as small as possible a heat capacity.

To amplify or increase these effects the microwave unit door can be formed so that a first layer is formed on both sides of the interior glass pane and/or a second layer is formed on both sides of the outer glass pane.

An effective prevention of condensate formation and screening may be obtained according to a preferred embodiment of the invention, when the first layer is a high-ohm electrically conductive layer with a surface resistance of up to 200Ω/□ and the second layer is a low-ohm electrically conductive layer with a surface resistance of 50Ω/□.

In order to guarantee the required visual observation, the invention provides that the electrically conductive layers, e.g. comprising indium/zinc oxide (ITO), fluorine-doped zinc oxide and/or aluminum doped zinc oxide.

A simple possibility for predetermining the temperature of the inner glass pane during heat up by the electrically conductive layers is to provide an inner conductive layer containing high resistance material, which has NTC behavior, according to an additional embodiment of the invention.

The electrical resistance of this sort of material decreases with increasing temperature, which limits the temperature of the interior glass pane during full load operating conditions.

These materials can be applied as a layer, e.g. as a lacquer or varnish or sol-gel layer. Alternatively they can be finely divided in a transparent glass or plastic matrix.

Materials are similarly conceivable, whose resistance can be varied by varying the applied electrical voltage or by varying current flow so that the absorption behavior for microwaves can be changed.

As an alternative to the electrically conductive layers according to an additional embodiment of the invention the microwave unit door can be formed so that at least the first layer is a transparent sol-gel layer, which is doped with nanoscale particles absorbing microwaves.

Glass ceramic particles, for example, which are present in the high quartz mixed crystal form, cause good absorption. Examples of this sort of material include glass with an Al—Li—Si composition.

Furthermore it is conceivable to apply an optically transparent plastic foil or foils, which is or are provided with a conductive coating, by means of a transparent glue or adhesive.

BRIEF DESCRIPTION OF THE DRAWING

The objects, features and advantages of the invention will now be illustrated in more detail with the aid of the following description of the preferred embodiments, with reference to the following figures, in which.

DETAILED DESCRIPTION OF THE INVENTION

Figure 1:
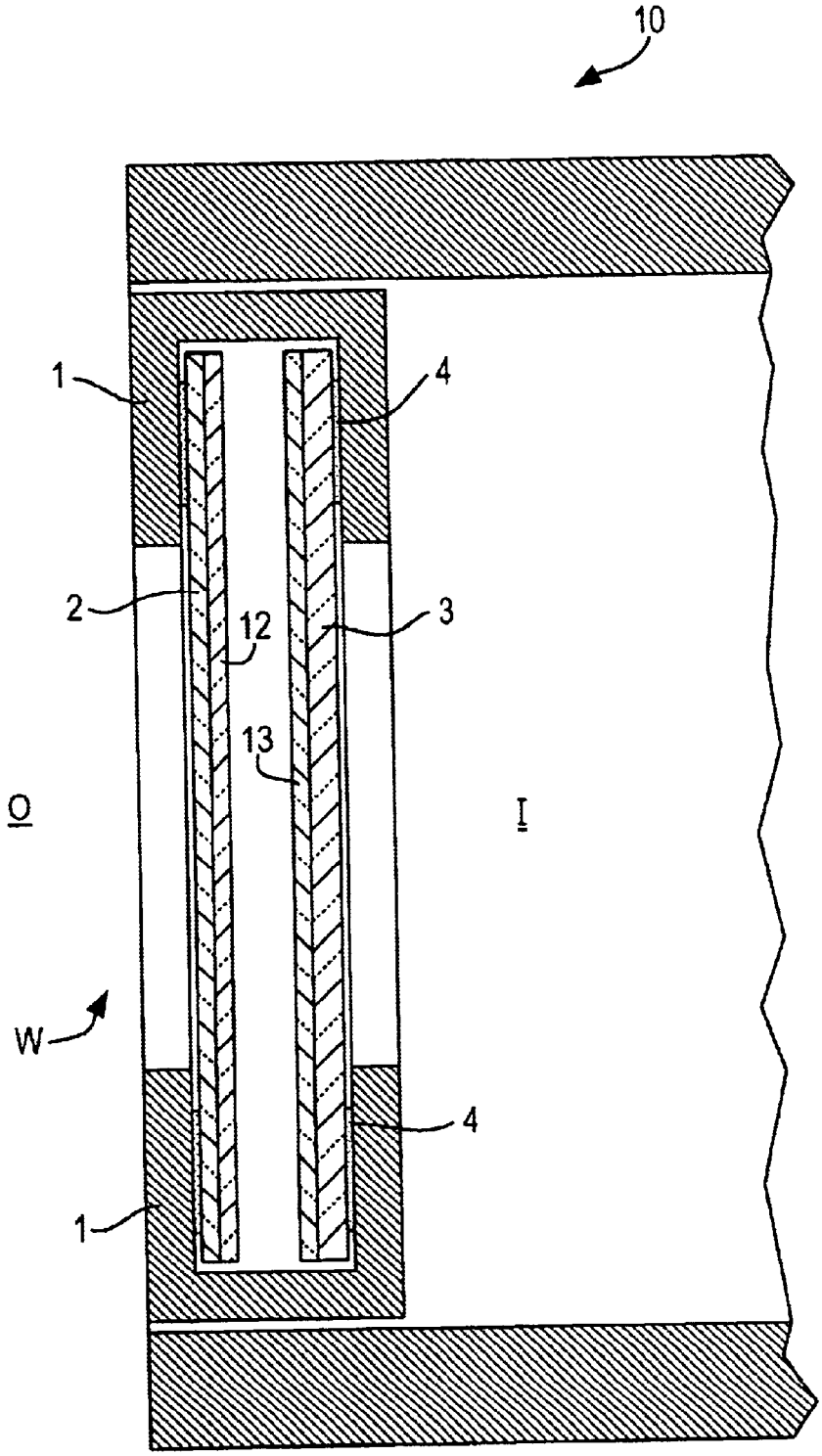
FIGS. 1 to 5 are respective cross-sectional views through different embodiments of a microwave unit door provided with a viewing window according to the invention, in which an interior glass pane is provided with at least one optically transparent layer that absorbs microwave radiation and the outer glass pane is provided with at least one optically transparent layer that reflects microwave radiation.

The microwave unit door with viewing window W comprises a metallic door frame 1 and an interior glass pane 3 and an outer glass pane 2 held spaced apart in the metallic door frame 1. The interior glass pane 3 closest to or facing the unit interior or processing space I is preferably made of a glass of trademark BOROFLOAT®. The outer glass pane 2 closest to or facing the surroundings or outside O is preferably made of a glass of trademark "SCHOTT® Thermally Prestressed Glass". The glass panes 2,3 are glued in the metallic door frame 1, preferably with an adhesive 4. This adhesive 4 guarantees a correct assembly of the glass panes 2,3 in the frame 1, in which the glass panes are supported in a permanently elastic shock-absorbing manner.

The interior glass pane 3 immediately adjacent to or closest to the processing space I has at least one optically transparent first layer 13 that absorbs microwave radiation, which is designed with sufficient microwave absorption ability or capacity so that it heats up preventing condensate formation.

In the embodiment shown in FIG. 1 the at least one optical transparent first layer 13 is formed on a side of the outer glass pane 3 that faces away from the processing space I and is thus inside the space between the glass panes 2,3.

Parts or elements of the microwave unit door that are the same or perform the same function in embodiments shown in FIGS. 2 to 5 as in FIG. 1 are given the same reference numbers. It should also be noted that the drawings are not "to scale" and the coatings are sometimes shown comparatively large in comparison to the glass panes.

Figure 2:
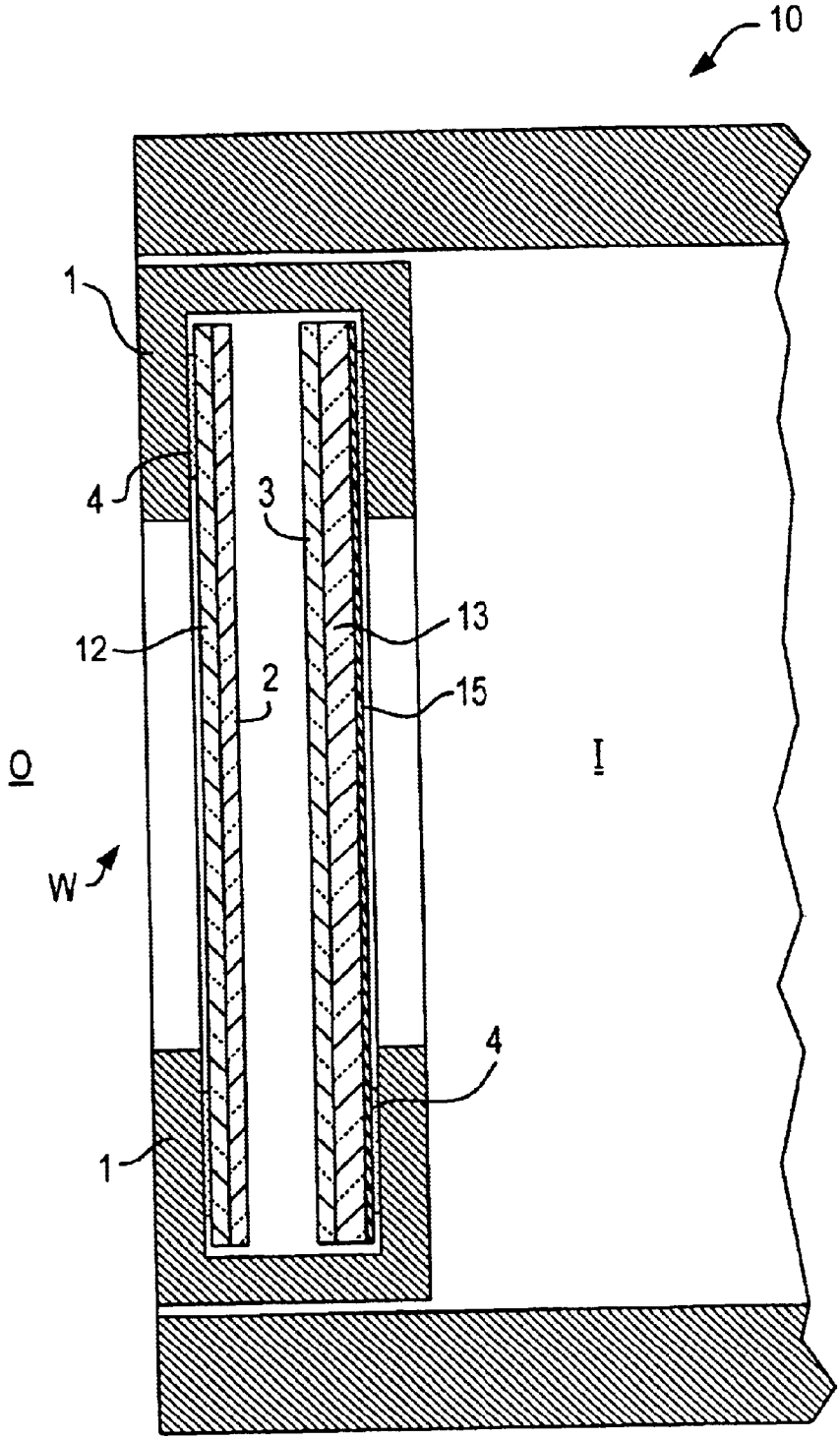

In the embodiment shown in FIG. 2 the viewing window W according to the invention has basically the same structure as the viewing window of FIG. 1. However the embodiment shown in FIG. 2 differs from that of FIG. 1, because the optically transparent first layer 13 that absorbs microwave radiation is provided on the side of the interior glass pane 3 that faces the processing or interior space I, i.e. the inner side of the glass pane 3. Also a scratch resistant coating, preferably a silicon oxide layer, is provided, which covers the first layer 13 on the glass pane 3.

Figure 3:
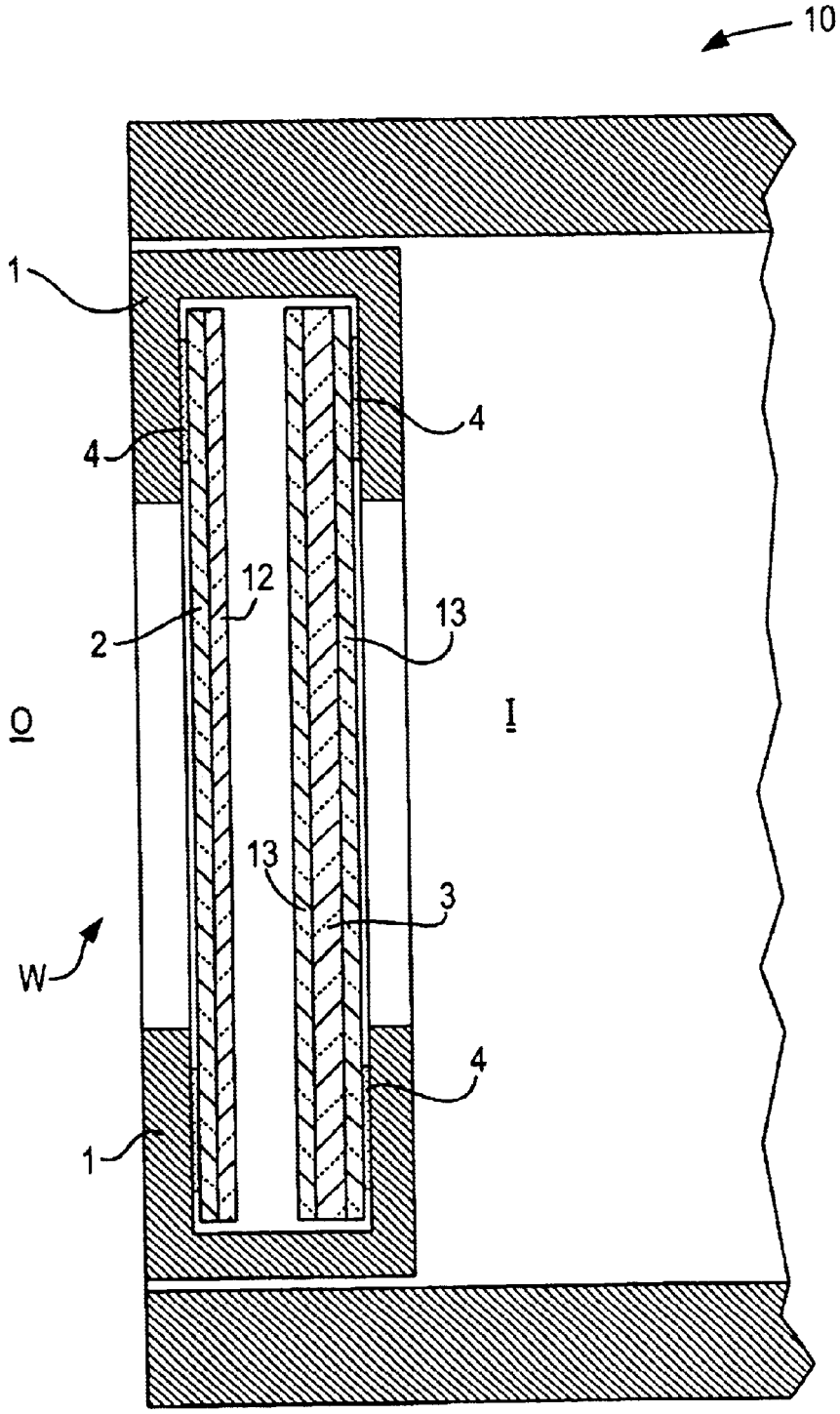

In contrast the embodiment shown in FIG. 3 has an optically transparent first layer 13 that absorbs microwave radiation on both sides of the glass pane 3.

The optically transparent first layer 13 in these embodiments can, for example, be a high-ohm electrically conductive layer with a surface resistance up to 200Ω/□. The outer glass pane 2 has at least one optically transparent second coating reflecting microwave radiation passing through the first layer. The second layer, for example, can be a low-ohm electrically conductive layer with a surface resistance of up to 50Ω/□. These electrically conductive layers can advantageously comprise indium/zinc oxide (ITO), fluorine-doped zinc oxide and/or aluminum-doped zinc oxide.

Figure 4:
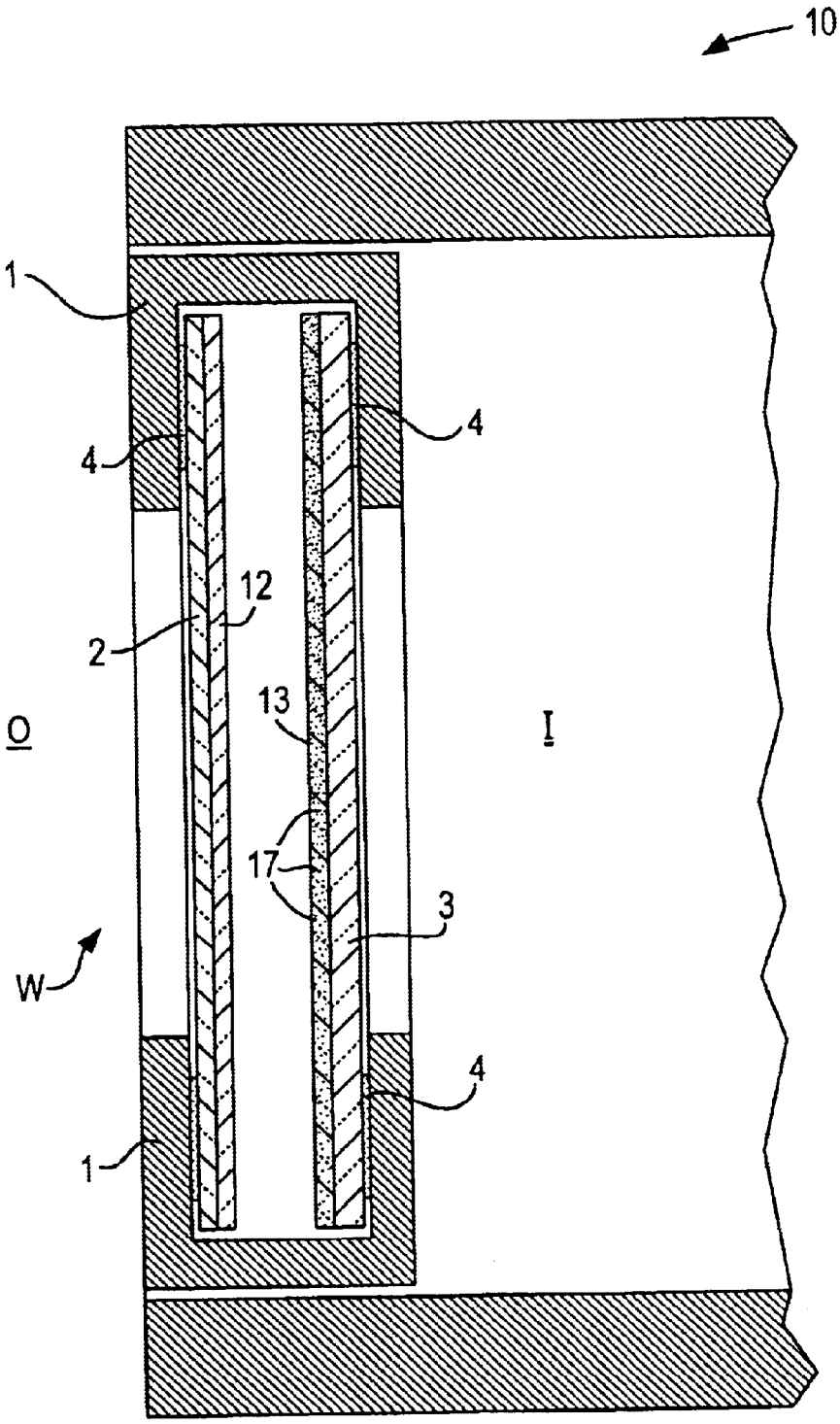

In an alternative embodiment shown in FIG. 4 the optically transparent first layer 13 can be a transparent sol-gel layer, which is doped with nanoscale microwave absorbing particles. These absorbing particles can be glass ceramic particles 17, which are present in high quartz mixed crystal form.

In an additional embodiment, which has a structure similar to FIG. 1, the first layer 13 can be an electrically conductive organic layer.

Figure 5:
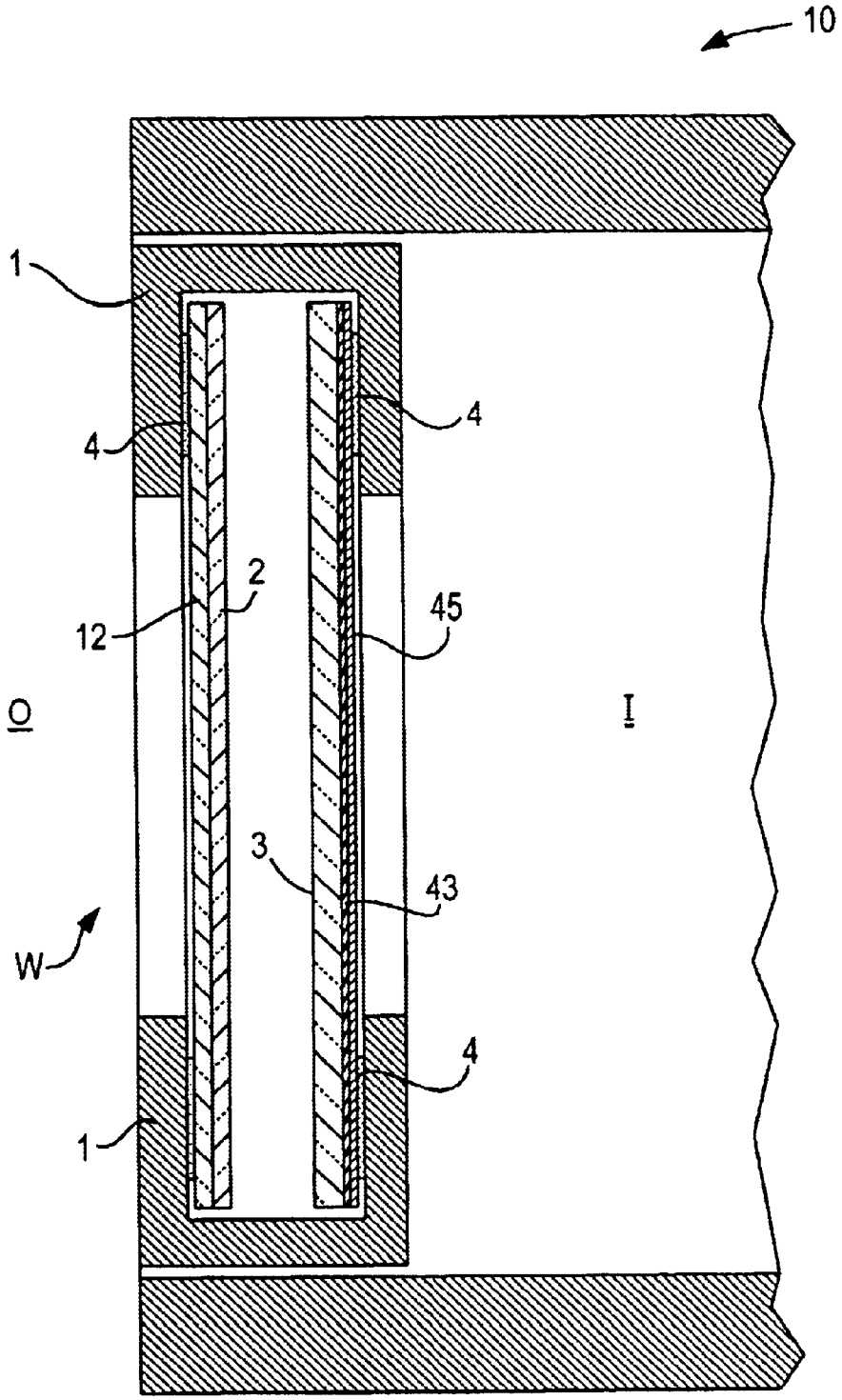

In other embodiments as shown in FIG. 5 at least the optically transparent first layer can be a conductively coated plastic foil, i.e. a plastic foil 42 provided with an electrically conductive coating or layer 45.

The disclosure in German Patent Application 103 07 217.9 of Feb. 20, 2003 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a microwave unit door with viewing window, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A microwave unit door with a viewing window (W), wherein said microwave unit door closes a processing space (I) of a microwave unit (10) and comprises a metallic door frame (1), an outer glass pane (2) and an interior glass pane (3), said outer glass pane (2) and said interior glass pane (3) being held spaced apart in the metallic door frame (1), said interior glass pane (3) being closer to the processing space (I) than said outer glass pane (2);

wherein the interior glass pane (3) has at least one optically transparent first layer (13) that absorbs microwave radiation, said at least one optically transparent first layer having a microwave absorption capability, so that said at least one optically transparent first layer (13) heats up to prevent condensate formation on the interior glass pane during operation of the microwave unit; and wherein the outer glass pane (2) has at least one optically transparent second layer (12) that reflects microwave radiation passing through the at least one optically transparent first layer (13).

2. The microwave unit door as defined in claim 1, wherein said at least one optically transparent first layer (13) is formed on a side of said interior glass pane (3) that is closest to the processing space (I).

3. The microwave unit door as defined in claim 2, wherein said at least one optically transparent first layer (13) is additionally provided with an outer scratch resistant coating (15).

4. The microwave unit door as defined in claim 3, wherein said outer scratch resistant coating (15) is a silicon oxide layer.

5. The microwave unit door as defined in claim 1, wherein said at least one optically transparent first layer (13) is formed on a side of said interior glass pane (3) that is facing away from or furthest from the processing space (I).

6. The microwave unit door as defined in claim 5, wherein the interior glass pane (3) is thinner than the outer glass pane (2).

7. The microwave unit door as defined in claim 1, wherein said at least one optically transparent first layer (13) is provided on both sides of the interior glass pane (3).

8. The microwave unit door as defined in claim 1 or 7, wherein said at least one optically transparent second layer (12) is provided on both sides of the outer glass pane (2).

9. The microwave unit door as defined in claim 1, wherein the at least one optically transparent first layer (13) is a high-ohm electrically conductive layer with a surface resistance of 200 Ω/□ and the at least one optically transparent second layer (12) is a low-ohm electrically conductive layer with a surface resistance of 50 Ω/□.

10. The microwave unit door as defined in claim 9, wherein said high-ohm electrically conductive layer and said low-ohm electrically conductive layer each comprise an indium/zinc oxide (ITO), a fluorine-doped zinc oxide and/or an aluminum-doped zinc oxide.

11. The microwave unit door as defined in claim 9, wherein an inner one of the electrically conductive layers contains high resistance material having NTC behavior.

12. The microwave unit door as defined in claim 9, wherein an inner one of the electrically conductive layers contains high resistance material having a variable resistance that varies according to an applied voltage or a variable current flow.

13. The microwave unit door as defined in claim 1, wherein at least said at least one optically transparent first layer (13) is a transparent sol-gel layer that is doped with nanoscale particles and said nanoscale particles absorb microwave radiation.

14. The microwave unit door as defined in claim 13, wherein said nanoscale particles that absorb microwave radiation are glass ceramic particles (17), which are present in high quartz mixed crystal form.

15. The microwave unit door as defined in claim 1, wherein said at least one optically transparent first layer (13) is an electrically conductive organic layer.

16. The microwave unit door as defined as claim 1, wherein at least said at least one optically transparent first layer comprises a plastic foil (43) and an electrically conductive coating (45) applied to the plastic foil (43).

* * * * *